US005491863A

United States Patent [19]

Dunn

[11] Patent Number: 5,491,863

[45] Date of Patent: Feb. 20, 1996

[54] COMBINED NIPPLE CLEANING AND BOTTLE CLEANING BRUSHES

[75] Inventor: Steven B. Dunn, Beverly Hills, Calif.

[73] Assignee: Munchkin Bottling, Inc., Van Nuys, Calif.

[21] Appl. No.: 334,693

[22] Filed: Nov. 4, 1994

[51] Int. Cl.[6] ..... A46B 3/18; A46B 15/00

[52] U.S. Cl. ..... 15/106; 15/114; 15/164; 15/184; 15/206

[58] Field of Search ..... 15/106, 184, 160, 15/206, 164, 210.1, 211

[56] References Cited

U.S. PATENT DOCUMENTS

| | | | |
|---|---|---|---|
| D. 250,068 | 10/1978 | Ducotey | D4/8 |
| D. 333,368 | 2/1993 | Flowers | D32/40 |
| 2,762,074 | 9/1956 | Danchig | 15/184 |
| 3,130,433 | 4/1964 | John | 15/105 |
| 3,358,311 | 12/1967 | Cunningham et al. | 15/105 |
| 3,358,314 | 12/1967 | Matibag | 15/246 |
| 4,023,677 | 4/1977 | Wittner et al. | 206/229 |
| 4,575,892 | 3/1986 | Ross | 15/106 |
| 4,809,389 | 3/1989 | Breitschmid | 151/167.1 |
| 5,339,480 | 8/1994 | Murg et al. | 15/106 |

FOREIGN PATENT DOCUMENTS 528464 5/1954 Belgium .

*Primary Examiner*—Edward L. Roberts, Jr.

*Attorney, Agent, or Firm*—Woodcock Washburn Kurtz Mackiewicz & Norris

[57] ABSTRACT

A utensil that is configured for scrubbing both baby bottles and nursing nipples for such bottles includes a handle that has a recess defined therein, a bottle brush operatively connected to the handle which is sized so as to be able to efficiently scrub an inside of a baby bottle, and a nipple brush assembly. The nipple brush assembly includes a nipple brush portion that is sized so as to be able to efficiently scrub an inside of a nursing nipple and a grip portion. It is releaseably attached to the handle so that said brush portion is positioned in the handle recess and the grip portion is grippable externally of the recess by a user, whereby said utensil can be used to conveniently scrub both baby bottles and nursing nipples.

18 Claims, 2 Drawing Sheets

COMBINED NIPPLE CLEANING AND BOTTLE CLEANING BRUSHES

BACKGROUND OF THE INVENTION

1. Field of the Invention

This invention pertains generally to the field of infant feeding and care. More specifically, this invention relates to an improved utensil for cleaning infant nursing bottles and nipples that is more hygienic, efficient and attractive than articles that are presently available for similar purposes are.

2. Description of the Prior Art

The importance of proper hygiene when handling and cleaning infant feeding equipment such as baby bottles and nursing nipples cannot be overstated. Ideally, bottles and nipples should be thoroughly scrubbed, then sterilized by immersion in boiling water between uses. Proper scrubbing is especially important after a nipple or bottle has been used to dispense fatty liquids, or liquids having suspended solids therein, such as cereal.

Bottle scrubbing brushes are common, as are nipple scrubbing brushes. Kitchens of new parents and other caregivers often include a bottle brush and a nipple brush in addition to a clutter of miscellaneous bottle components, containers of formula or mothers'milk, sterilization equipment, bibs and other items that are too numerous to list. Storage space for all of the new paraphernalia in a new parent's kitchen can easily become insufficient. It is important, though, that bottle and nipple brushes, and particularly the latter, be stored in locations where the cleansing surface thereon are not in contact with germ-laden surfaces.

SUMMARY OF THE INVENTION

Accordingly, it is an object of the invention to provide an improved baby bottle and nipple cleaning assembly that is attractive, efficiently stored, convenient to use and more hygienic than the individual brushes that are presently available.

In order to achieve the above and other objects of the invention, a utensil that is configured for scrubbing both baby bottles and nursing nipples for such bottles includes, according to a first aspect of the invention, a handle, the handle having a recess defined therein; a bottle brush operatively connected to the handle, the bottle brush being sized and configured so as to be able to efficiently scrub the inside of a baby bottle; and a nipple brush assembly, the nipple brush assembly including a nipple brush portion that is sized and configured so as to be able to efficiently scrub an inside of a nursing nipple and a grip portion, said nipple brush assembly being releasably attached to said handle so that said brush portion is positioned in said recess and said grip portion is grippable externally of said recess by a user, whereby said utensil can be used to conveniently scrub both baby bottles and nursing nipples.

A utensil that is configured for scrubbing both baby bottles and nursing nipples for such bottles includes, according to a second aspect of the invention, a handle, the handle having a recess defined therein; a bottle brush operatively connected to the handle, the bottle brush being sized and configured so as to be able to efficiently scrub an inside of a baby bottle; and a nipple brush assembly, the nipple brush assembly including a nipple brush portion that is sized and configured so as to be able to efficiently scrub an inside of a nursing nipple, the nipple brush assembly being releasably positioned in the recess in the handle, whereby the utensil can be used to conveniently scrub both baby bottles and nursing nipples.

According to a third aspect of the invention, a utensil that is configured for scrubbing both baby bottles and nursing nipples for such bottles, includes a handle, the handle having a recess defined therein; a bottle brush operatively connected to the handle, the bottle brush being sized so as to be able to efficiently scrub an inside of a baby bottle, the bottle brush being generally cylindrical in shape; and a nipple brush assembly, the nipple brush assembly comprising a nipple brush portion that is sized so as to be able to efficiently scrub an inside of a nursing nipple and a grip portion, the nipple brush portion being smaller than the bottle brush and being substantially cylindrical in shape, the nipple brush assembly being releasably attached to the handle so that the brush portion is positioned in the recess and the grip portion is grippable externally of the recess by a user, whereby the utensil can be used to conveniently scrub both baby bottles and nursing nipples.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figures 1, 2:
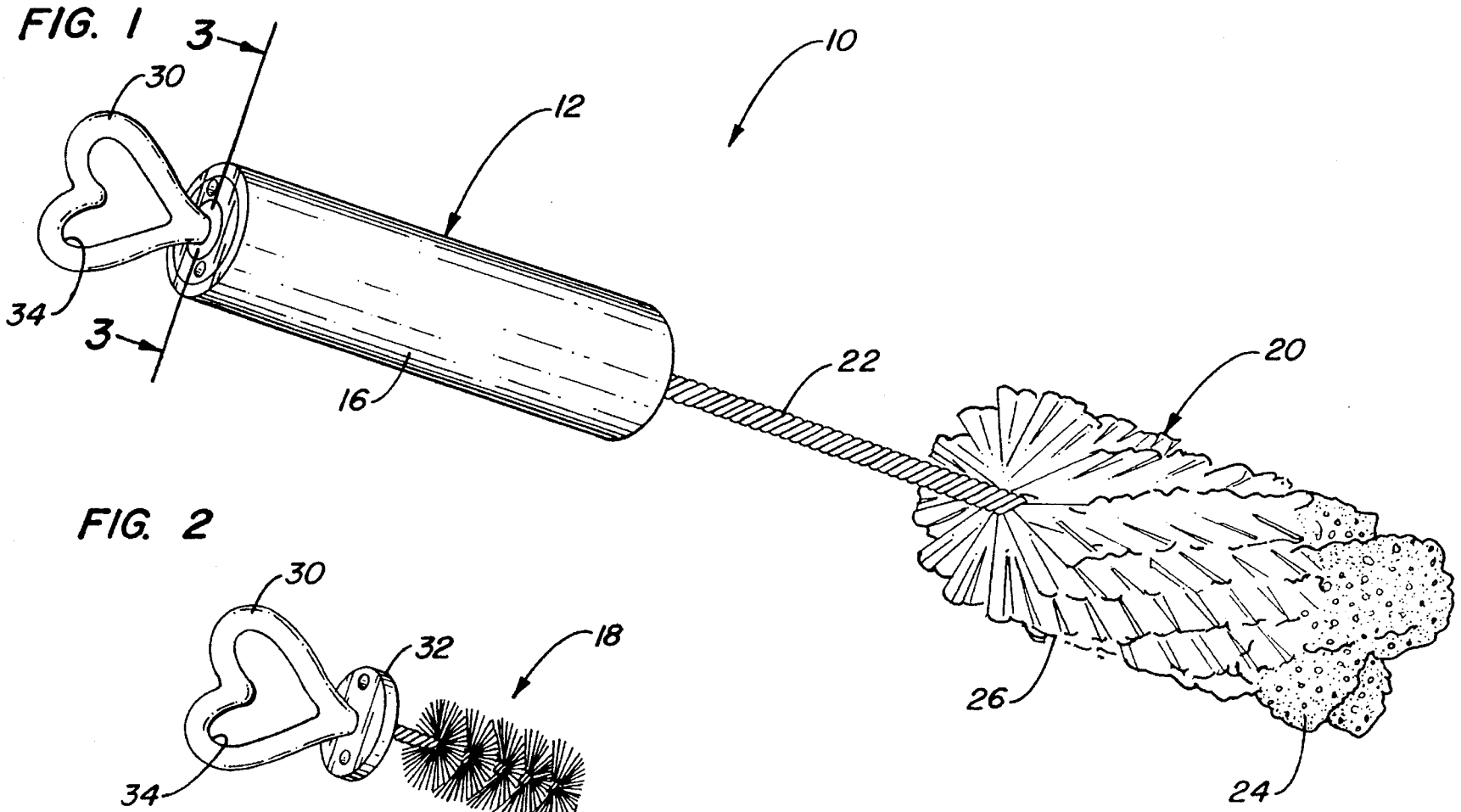
FIG. 1 is a perspective view of a utensil that is constructed according to a preferred embodiment of the invention.
FIG. 2 is a perspective view of a component of the utensil that is depicted in FIG. 1.

Referring now to the drawings, wherein like reference numerals designate corresponding structure throughout the views, and referring in particular to FIG. 1, a utensil 10 that is constructed according to a preferred embodiment of the invention is configured for scrubbing both baby bottles and nursing nipples for such bottles. As may be seen in FIGS. 1 and 3, utensil 10 includes a handle 12 having a longitudinally oriented recess 14 defined therein. Handle 12 includes a resilient outer grip surface 16, which is preferably fabricated from a resilient polymeric material that is dishwasher-proof, such as polycarbonate or ABS plastics. Handle 12 is thus configured to be able to receive a nipple brush assembly 18, depicted in FIG. 2, as will be described in greater detail below.

Referring again to FIG. 1, it will be seen that utensil 10 includes a bottle brush 20 that is sized and configured so as to be able to efficiently scrub an inside of a baby bottle. In the most preferred embodiment, bottle brush 20 is approximately 3½ inches in length, with a diameter of approximately 2 to 2½ inches. As may be seen in FIG. 1, bottle brush 20 is connected to handle 12 by a flexible metallic stem 22, and includes a sponge-like end portion 24 and a bristled scrubbing portion 26. Bottle brush 20 is generally cylindrical in shape, as is apparent from FIG. 1.

Figure 3:
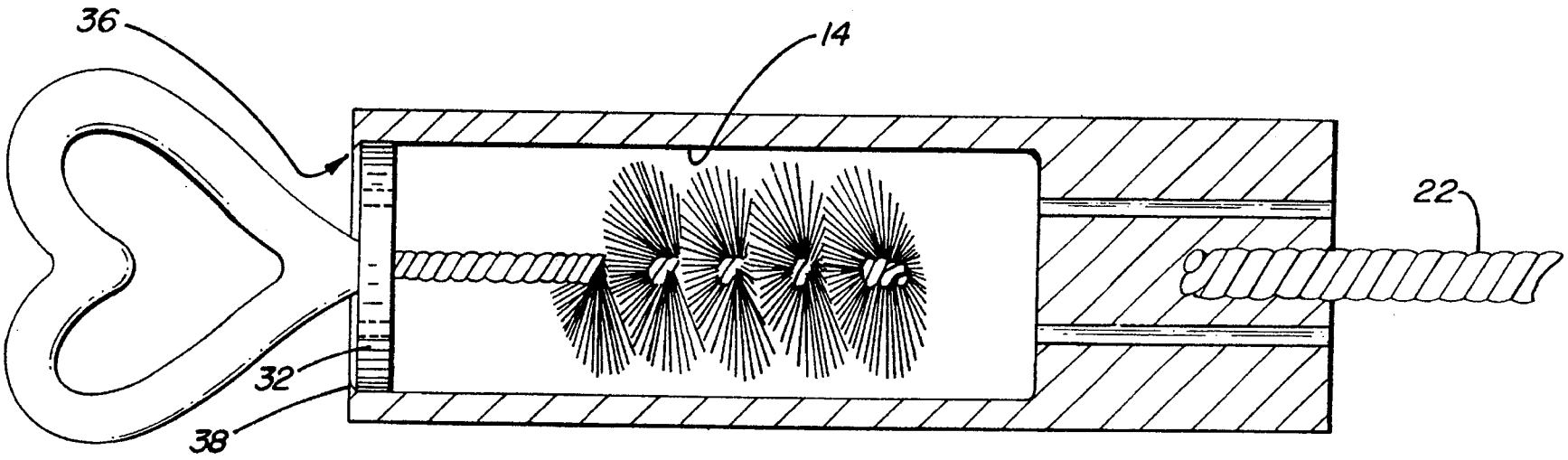
FIG. 3 is a cross-sectional view taking along lines 3—3 in FIG. 1.

Looking now to FIGS. 2 and 3, it will be seen that nipple brush assembly 18 includes a nipple brush portion 28 and a grip portion 30 which includes a locking plate 32 and a hole 34 defined therein for hanging utensil 10 on a peg or other projection. In the assembled orientation that is depicted in FIGS. 1 and 3, nipple brush assembly 18 is releasably attached to handle 12 by an interference fit 36 that is formed between locking plate 32 and a lip 38 that is defined in handle 12 at an opening of recessed 14. Interference fit 36 is constructed to withstand a withdrawal force when locked that exceeds the entire weight of utensil 10, so that the entire utensil 10 maybe hung from grip portion 30 of nipple brush assembly 18. Alternatively, a twist fit or snap-in fit connection could be provided.

As may be seen in FIGS. 1 and 3, air holes are preferably defined in grip portion 30 and/or handle 12 to permit air to be displaced to and from recess 14 during insertion and withdrawal of nipple brush assembly 18 from the handle 12.

In the most preferred embodiment, grip portion 30 includes an ornamental design, preferably a heart-shaped design, having a space defined therein for hanging utensil 10 on a peg or other projection.

Since nipple brush assembly 18 is ordinarily stored within the recess 14 that is defined in the handle 12 of the utensil 10, it is insulated against contact with germ-laden surfaces such as countertops, sinks, or other utensils. Moreover, the hole 34 in grip portion 30 enables the entire utensil 10 to be hung in a location where contact with other utensils or surface is unlikely. The invention achieves these advantages in an attractive, ornamental configuration that will make the rigors of childhood and parenthood alike a more exciting experience.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A utensil that is configured for scrubbing both baby bottles and nursing nipples for such bottles, comprising:

a handle, said handle having a recess defined therein;

a bottle brush operatively connected to said handle, said bottle brush being sized and configured so as to be able to efficiently scrub an inside of a baby bottle; and a nipple brush assembly, said nipple brush assembly comprising a nipple brush portion that is sized and configured so as to be able to efficiently scrub an inside of a nursing nipple and a grip portion, said nipple brush assembly being releaseably attached to said handle so that said brush portion is positioned in said recess and said grip portion is grippable externally of said recess by a user, whereby said utensil can be used to conveniently scrub both baby bottles and nursing nipples.

2. A utensil according to claim 1, wherein said handle comprises a resilient outer grip surface.

3. A utensil according to claim 1, wherein said nipple brush assembly is releaseably attached to said handle by an interference fit.

4. A utensil according to claim 1, wherein said bottle brush is generally cylindrical in shape so as to approximate an inside of a baby bottle.

5. A utensil according to claim 1, wherein said bottle brush comprises a sponge-like end portion and a bristled scrubbing portion.

6. A utensil according to claim 5, wherein said bristled scrubbing portion is substantially cylindrical in shape.

7. A utensil according to claim 1, wherein said bottle brush is connected to said handle by a flexible metallic stem.

8. A utensil according to claim 1, wherein said grip portion has a hole defined therein for hanging said utensil on a peg.

9. A utensil according to claim 1, wherein said grip portion comprises an ornamental design.

10. A utensil according to claim 1, wherein said grip portion comprises a heart-shaped design having a space defined therein for hanging said utensil on a peg.

11. A utensil that is configured for scrubbing both baby bottles and nursing nipples for such bottles, comprising:

a handle, said handle having a recess defined therein;

a bottle brush operatively connected to said handle, said bottle brush being sized and configured so as to be able to efficiently scrub an inside of a baby bottle; and a nipple brush assembly, said nipple brush assembly comprising a nipple brush portion that is sized and configured so as to be able to efficiently scrub an inside of a nursing nipple, said nipple brush assembly being releaseably positioned in said recess in said handle, whereby said utensil can be used to conveniently scrub both baby bottles and nursing nipples.

12. A utensil according to claim 11, wherein said handle comprises a resilient outer grip surface.

13. A utensil according to claim 11, wherein said nipple brush assembly is releaseably attached to said handle by an interference fit.

14. A utensil according to claim 11, wherein said bottle brush is generally cylindrical in shape so as to approximate an inside of a baby bottle.

15. A utensil according to claim 11, wherein said bottle brush comprises a sponge-like end portion and a bristled scrubbing portion.

16. A utensil according to claim 15, wherein said bristled scrubbing portion is substantially cylindrical in shape.

17. A utensil according to claim 11, wherein said bottle brush is connected to said handle by a flexible metallic stem.

18. A utensil that is configured for scrubbing both baby bottles and nursing nipples for such bottles, comprising:

a handle, said handle having a recess defined therein;

a bottle brush operatively connected to said handle, said bottle brush being sized so as to be able to efficiently scrub an inside of a baby bottle, said bottle brush being generally cylindrical in shape; and a nipple brush assembly, said nipple brush assembly comprising a nipple brush portion that is sized so as to be able to efficiently scrub an inside of a nursing nipple and a grip portion, said nipple brush portion being smaller than said bottle brush and being substantially cylindrical in shape, said nipple brush assembly being releaseably attached to said handle so that said brush portion is positioned in said recess and said grip portion is grippable externally of said recess by a user, whereby said utensil can be used to conveniently scrub both baby bottles and nursing nipples.

* * * * *